US006931684B1

(12) United States Patent
Henegar

(10) Patent No.: US 6,931,684 B1
(45) Date of Patent: Aug. 23, 2005

(54) BED HAVING AN INTEGRAL REFUSE DISPOSAL SYSTEM

(76) Inventor: Patricia H. W. Henegar, 1930 E. Medlock Dr., Phoenix, AZ (US) 85016

( * ) Notice: Subject to any disclaimer, the term of this patent is extended or adjusted under 35 U.S.C. 154(b) by 0 days.

(21) Appl. No.: 10/869,017

(22) Filed: Jun. 16, 2004

(51) Int. Cl.[7] ..... A61G 7/02; B65B 9/10
(52) U.S. Cl. ..... 5/695; 5/604; 53/459; 53/567
(58) Field of Search ..... 5/695, 604, 691; 4/450–452, 4/456, 479, 483, 484; 53/567, 576, 459

(56) References Cited

U.S. PATENT DOCUMENTS

| | | | | | |
|---|---|---|---|---|---|
| 760,755 | A | * | 5/1904 | Radcliff | 5/695 |
| 1,054,452 | A | | 2/1913 | Sayen | |
| 1,257,085 | A | | 2/1918 | Mahoney | |
| 1,295,844 | A | | 3/1919 | Bidwell | |
| 1,372,505 | A | | 3/1921 | Handon | |
| 1,577,832 | A | * | 3/1926 | Maggi | 5/695 |
| 1,604,205 | A | * | 10/1926 | Tiffany | 5/695 |
| 2,418,259 | A | | 4/1947 | Harmanson | |
| 3,023,429 | A | | 3/1962 | Borotra bom Chauvac | |
| 3,729,749 | A | * | 5/1973 | Rosecrans | 4/452 |
| 3,757,355 | A | | 9/1973 | Allen et al. | |
| 3,849,811 | A | | 11/1974 | Cyll | |
| 4,011,610 | A | * | 3/1977 | Parker, III | 5/604 |
| 4,222,133 | A | | 9/1980 | Csatary | |
| 4,244,066 | A | * | 1/1981 | Rukawina | 5/691 |
| 4,677,700 | A | * | 7/1987 | Su | 5/604 |
| 4,847,932 | A | * | 7/1989 | Baribault, Jr. | 5/695 |
| 4,869,049 | A | | 9/1989 | Richards et al. | |
| 4,934,529 | A | | 6/1990 | Richards et al. | |
| 4,944,058 | A | * | 7/1990 | Carnahan et al. | 5/604 |
| 5,044,023 | A | * | 9/1991 | Carnahan et al. | 5/605 |
| 5,056,293 | A | | 10/1991 | Richards et al. | |
| 5,060,325 | A | * | 10/1991 | Carnahan et al. | 5/605 |
| 5,590,512 | A | | 1/1997 | Richards et al. | |
| 5,901,390 | A | * | 5/1999 | Williams | 5/604 |
| D453,277 | S | | 2/2002 | Wilson | |
| 6,804,930 | B2 | * | 10/2004 | Stravitz | 53/211 |
| 6,851,251 | B2 | * | 2/2005 | Stravitz | 53/567 |
| 2002/0078665 | A1 | * | 6/2002 | Salman et al. | 53/459 |
| 2002/0170275 | A1 | * | 11/2002 | Salman et al. | 53/459 |
| 2003/0218022 | A1 | * | 11/2003 | Chomik et al. | 220/908 |
| 2004/0194433 | A1 | * | 10/2004 | Chomik et al. | 53/459 |
| 2005/0028491 | A1 | * | 2/2005 | Stravitz | 53/470 |
| 2005/0044819 | A1 | * | 3/2005 | Chomik et al. | 53/459 |

* cited by examiner

*Primary Examiner*—Robert G. Santos
(74) *Attorney, Agent, or Firm*—Cahill, von Hellens & Glazer, P.L.C.

(57) ABSTRACT

A bed is provided with a mattress having a removable insert, the insert incorporates an opening therein to receive a seat. The seat includes a flange contacting the top surface of the removable insert. An annular cartridge of compressed disposable tubing is positioned within an annular well formed in the bottom surface of the removable insert. The disposable tubing extends from the annular cartridge upward over the flange of the seat and downward through the opening in the mattress insert.

18 Claims, 2 Drawing Sheets

BED HAVING AN INTEGRAL REFUSE DISPOSAL SYSTEM

FIELD OF THE INVENTION

The present invention relates to beds for use by incapacitated patients, and more particularly, beds having facilities for accommodating reclining incontinent patients having a need for waste elimination without leaving the bed.

BACKGROUND OF THE INVENTION

Patients that are incontinent and confined to a bed present obvious problems to nurses and other care givers. Many times, the patient cannot sufficiently control bodily functions to forewarn the attending care giver to provide assistance such as bedpans or other waste collection systems. The results are usually an embarrassment for the patient and the requirement for the expenditure of substantial time and effort on the part of the care giver to clean both the patient and the bed. Such events necessitate, at the least, changing the bedding, and perhaps even the mattress. The time expended in such cleaning operations greatly increases the expense of the care facility and the cost to the patient. Further, the unpleasant cleaning task has demoralizing effects on the patient and makes it difficult for the care facility to retain competent care givers.

OBJECTS OF THE INVENTION

It is therefore an object of the present invention to provide a bed having an integral disposal system.

It is also an object of the present invention to provide a waste disposal system for use by a bedridden patient.

It is a further object of the present invention to reduce the time and effort encountered by a care giver when cleaning after elimination by an incontinent patient.

It is still another object of the present invention to permit waste elimination of a bedridden patient with the least discomfort and embarrassment.

It is still another object of the present invention to provide a convenient and economical system for patient waste removal.

SUMMARY OF THE INVENTION

The present invention incorporates a bed, typically of the type found in hospitals and care facilities such as long term care organizations. The bed may be formed of two mattresses of foam material each having predetermined compression characteristics. The top mattress is constructed having a removable insert that incorporates an opening to receive a seat extending into the opening. A flexible, collapsible, plastic tubular member is positioned in the bottom of the removable insert and extends upwardly in the opening and surrounding the seat positioned in the opening. The plastic tubular member continues upwardly over the top of the seat and downwardly through the seat into the opening to extend to a position beneath the bed. The seat is positioned to register with the patient such that elimination by the patient will cause the resulting waste material to drop through the seat and into the tubular material.

BRIEF DESCRIPTION OF THE DRAWINGS

The present invention may more readily be disclosed by reference to the accompanying drawings in which.

DESCRIPTION OF THE ILLUSTRATED EMBODIMENT

Figure 1:
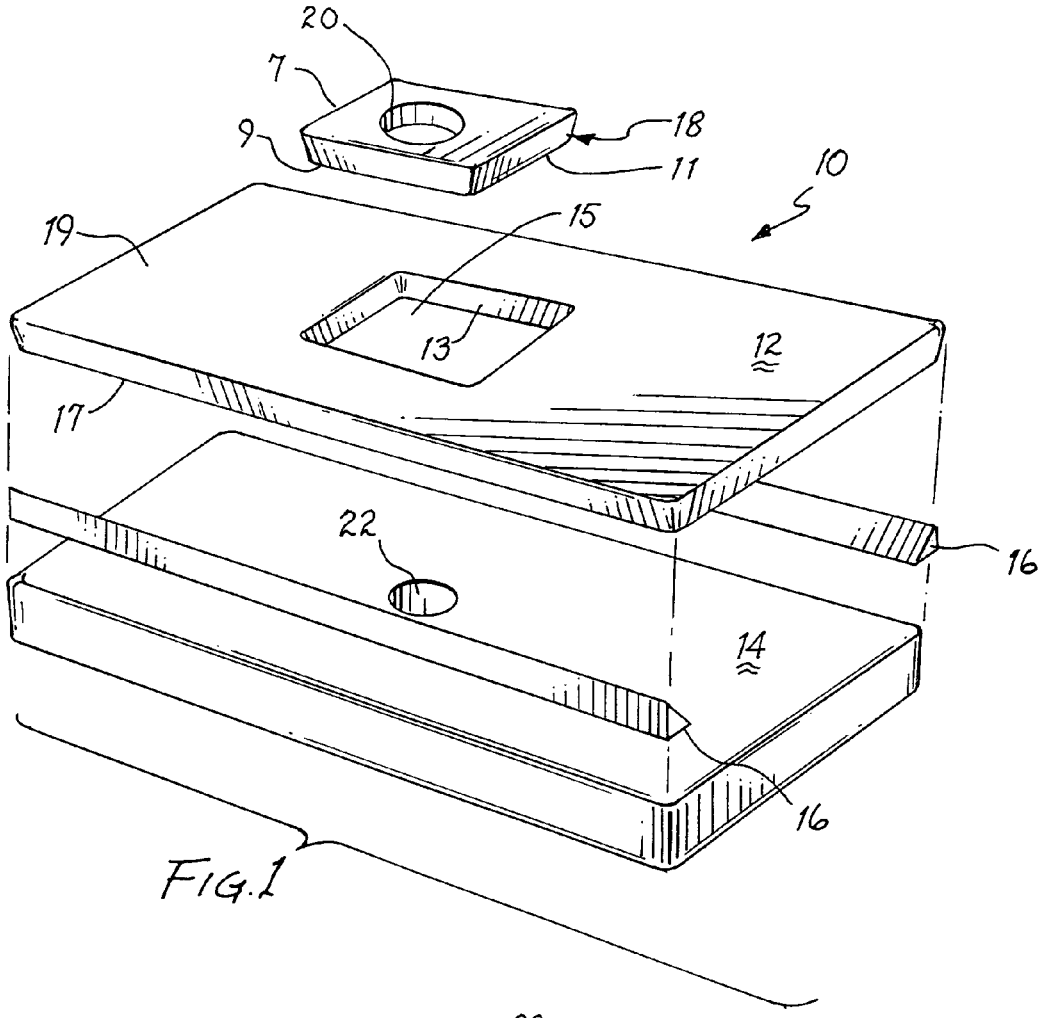
FIG. 1 is an exploded perspective view of a mattress suitable for use in the system of the present invention.

Referring now to FIG. 1, a mattress 10 is shown comprising an upper mattress pad 12 and a lower mattress pad 14. The use of dual pads in hospital mattresses has become common, and permits the selection of compression characteristics to suit patient comfort while providing the most economical mattress combination for the hospital or care facility. Typically, the upper mattress may be chosen for patient comfort and constructed of a modern viscoelastic foam material, while the lower mattress may be selected from a firmer material selected from a suitable polyurethane expanded foam. Edge reinforcement members 16 are positioned to add strength and necessary longitudinal rigidity to the structure.

In the embodiment chosen for illustration in FIG. 1, a removable mattress insert 18 is provided. An opening 20 is positioned in the insert to receive a seat to be described herein. The insert 18 and the included opening 20 are positioned relative to the mattress 12 to be in registration with a patient reclining on the mattress to permit any waste material from the patient to pass through the seat and the opening. A second opening 22 is formed in the lower mattress 14 and is positioned in registration with the first opening 20. The second opening 22 has a slightly smaller diameter than the opening 20 for reasons that will become apparent as the description proceeds. The edges 11 of the insert 18 are tapered to correspond to matching tapered edges 13 of the opening 15 provided in the mattress 12. This tapering assists the positioning of the insert in the mating opening provided in the mattress. When the insert 18 is positioned in the opening 15, the top and bottom surfaces 7 and 9 are coplanar with the top and bottom surfaces 19 and 17 of the mattress 12 respectively.

Figure 2:
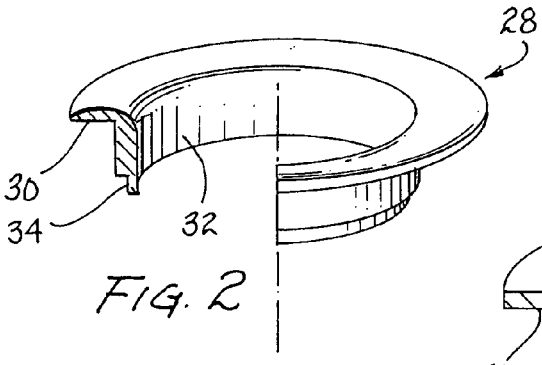
FIG. 2 is a perspective view of a refuse receiving seat for use in the system of the present invention.

Referring to FIG. 2, a perspective view, partly in section, of a seat for use in the invention is shown. The seat 28 includes a horizontally extending flange 30, a vertically extending body 32 and an annular notch 34. The seat 28 is positioned in the opening 20 of the mattress insert 18 and adjacent the top surface 7 of the mattress insert as will be described. The seat may be formed of a suitable "skinned" foam material that is soft to the touch but sufficiently rigid to retain its shape.

Figure 3:
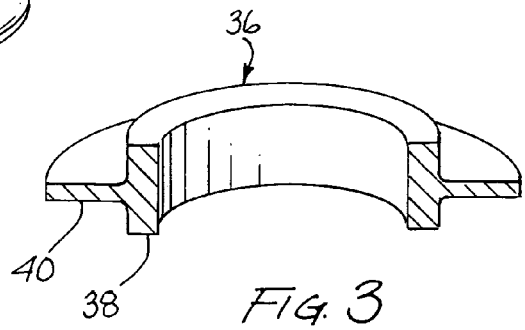
FIG. 3 is a perspective view, partly in section, of a capture ring for use in the system of the present invention.

FIG. 3 is a perspective view, partly in section, of a capture ring to be molded adjacent to the bottom surface of the mattress insert in a manner to be described. The capture ring 36 includes a cylindrical ring body 38 axially aligned with the opening or hole 20 and an integral radially extending annular flange 40. The capture ring may be formed of rigid plastic material and is intended to position and hold a supply of tubular plastic material as will be described herein.

Figure 4:
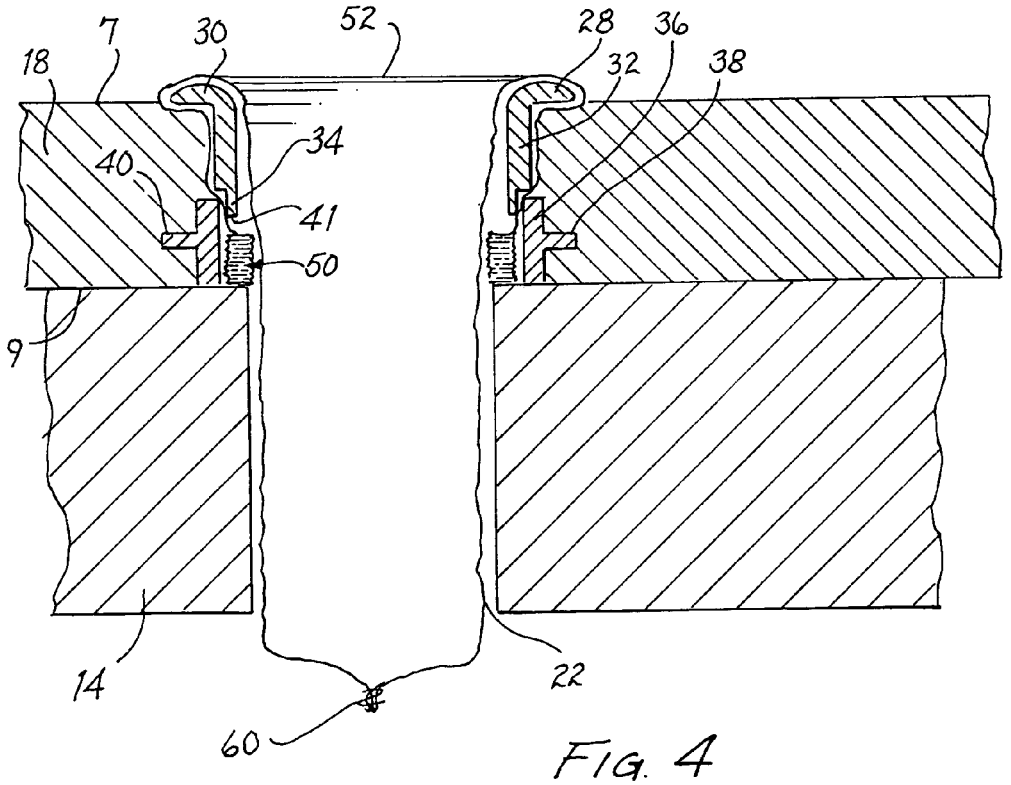
FIG. 4 is a cross-sectional view of a refuse disposal system constructed in accordance with the teachings of the present invention.

Referring to FIG. 4, a cross section of refuse disposal system constructed in accordance with the teachings of the present invention is shown. The lower mattress 14 is shown with the mattress insert 18 in place. The seat 28 is positioned in the hole 20 with the flange 30 resting on the upper surface 7 of the insert 18. The flange 30 may be flattened to make it less intrusive to the body of the patient. That is, the material and shape of the flange may be formed to render the texture and contour as "mattress-like" as possible to make the juncture of the seat and mattress "seamless" and thus more comfortable to the patient. The body 32 of the seat extends into the hole 20 with the notch 34 nesting in the ring body 38 of the capture ring 36. The capture ring 36 is molded into the removable mattress insert 18 with the ring body 38 terminating flush with the lower surface 19 of the mattress insert. The radially extending annular flange 40 of the capture ring 36 locks the ring in position and thus forms an annular well 41 receptacle to receive and hold an annular cartridge 50.

Figure 5:
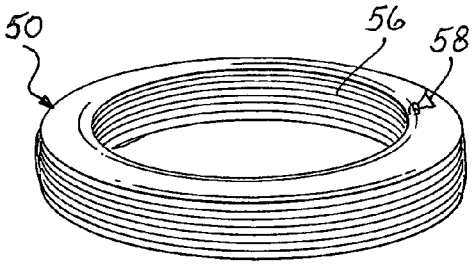
FIG. 5 is a perspective view of a suitable cartridge of plastic tubing material for use in the system of FIG. 4.
Figure 6:
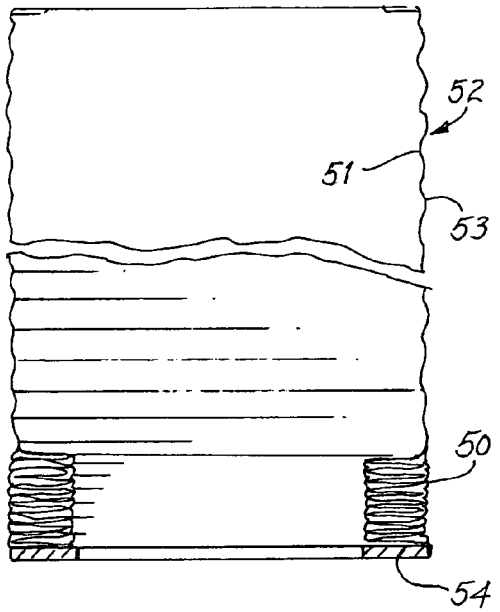
FIG. 6 is a cross-sectional view, partly exploded, of the cartridge of FIG. 5 and useful in the refuse disposal system of the present invention.

Referring to FIGS. 5 and 6, an annular cartridge is shown for use in the disposal system of the present invention. The cartridge comprises an elongated tubular flexible plastic member 52 that is folded and compressed into a tight ring-shaped or toroid-shaped package. The bottom of the tubular member may be attached to a disposable ring 54 that may be made of cardboard or the like, and enclosed in a suitable wrapping material 56 such as paper. The toroid shaped package may be opened using a "draw string" 58 in a well known manner, and the opened package inserted into the capture ring 36 that has been exposed at the bottom of the mattress insert 18. The tubular flexible member 52 is formed with two plies or opposing surfaces that have received different treatment. The outer surface 53 is intended to come into contact with the patient and therefore is formed of a soft paper or fabric layer or is fiber flocked. This surface should be pleasant to the touch and preferably moisture absorbent. The inner surface or layer 51 is a smooth plastic surface and contacts the seat 28 and must exhibit low contact sliding friction to facilitate the feeding of fresh material when the tubular material is advanced by the care giver.

In use, and prior to the patient occupying the bed, the attendant or care giver removes the seat 28 and the upper mattress insert 18 to expose the bottom surface 17 of the insert 18 and the bottom of the capture ring 36. An annular cartridge is selected and the package opened to expose the tubular member within. The package is placed in the annular well 41 as shown in FIG. 4, and the tubular member is then withdrawn from the package and extended upwardly out the opening 20 in the insert. The seat 28 is then replaced with the flexible tubular member extending around the outside of the seat and then downwardly through the seat to below the removable mattress insert 18. The insert is then replaced, and the flexible plastic tubular member is "threaded" through the hole 22 in the bottom mattress 14. The tubular member thus extends to below the bed and is tied or clamped as schematically indicated at 60 in any convenient manner to render the member leak proof. The tubular member is locked in position by the nesting of the annular notch 34 of the seat 28 within the ring body 38 of the capture ring 36.

The patient may then be placed on the bed and positioned to register with the seat. When elimination occurs, the refuse exits through the seat and downwardly through the upper and lower mattresses into the closed tubular member located beneath the bed. The patient may be repositioned to relieve the pressure on the seat and permit the care giver to pull fresh tubular material from the material cartridge 50 by pulling on the material from beneath the bed until fresh material appears. The flexible plastic tubular material may then be tied off beneath the bed with the refuse contained therein. The tubular member is then sealed or tied as in the beginning and the system is immediately available for the next occurrence.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. A bed having an integral refuse disposal system comprising:

(a) a mattress having a top surface and a bottom surface and an opening extending therethrough, the opening positioned to permit registration with a reclining patient;

(b) a seat member extending into said opening positioned adjacent the top surface of said mattress and having a flange resting on said top surface;

(c) an annular well formed in said mattress surrounding said opening;

(d) an annular cartridge of compressed disposable tubing positioned within said annular well; and (e) said disposable tubing extending upwardly from said cartridge over said seat member and downwardly through the opening.

2. The bed set forth in claim 1 wherein said annular well is formed in the bottom surface of said mattress surrounding said opening.

3. The bed set forth in claim 1 wherein said annular well is formed by a capture ring having a cylindrical body mounted in said mattress and aligned with said opening.

4. The bed set forth in claim 1 wherein said disposable tubing has a smooth plastic inner surface and a soft moisture absorbent outer surface.

5. The bed set forth in claim 1 wherein said disposable tubing has a smooth plastic inner surface and a fiber flocked outer surface.

6. A bed having an integral refuse disposal system comprising:

(a) a mattress having a removable mattress insert therein, said insert having a top surface and a bottom surface and an opening extending therethrough, the opening positioned to permit registration with a reclining patient;

(b) a seat member extending into said opening and positioned adjacent the top surface of said removable mattress insert and having a flange resting on the top surface of said removable mattress insert;

(c) an annular well formed in said mattress insert surrounding said opening;

(d) an annular cartridge of compressed disposable tubing positioned within said annular well; and (e) said disposable tubing extending upwardly from said cartridge over said seat member and downwardly through the opening.

7. The bed of claim 6 wherein the removable mattress insert top surface and bottom surface are coplanar with a top and a bottom surface of said mattress respectively.

8. The bed of claim 6 wherein said well is formed by a capture ring having a cylindrical body mounted in said mattress insert and aligned with said opening.

9. The bed of claim 6 wherein said disposable tubing has a smooth plastic inner surface and a soft moisture absorbent outer surface.

10. The bed of claim 6 wherein said disposable tubing has a smooth plastic inner surface and a fiber flocked outer surface.

11. A bed having an integral refuse disposal system comprising:

(a) a first mattress having a top surface and a bottom surface and a first opening extending therethrough;

(b) a second mattress in contact with the bottom surface of said first mattress and having a second opening extending therethrough and aligned with said first opening, said openings positioned to permit registration with a reclining patient;

(c) a seat member extending into said first opening and having a flange extending over and contacting the top surface of said first mattress;

(d) an annular well formed in said first mattress surrounding said first opening;

(e) an annular cartridge of compressed disposable tubing positioned within said annular well; and (f) said disposable tubing extending upwardly from said cartridge over the flange of said seat member and downwardly through the first and second openings.

12. The bed of claim 11 wherein said well is formed by a capture ring having a cylindrical body mounted in said first mattress and aligned with said opening.

13. The bed of claim 11 wherein said disposable tubing has a smooth plastic inner surface and a soft moisture absorbent outer surface.

14. The bed of claim 11 wherein said disposable tubing has a smooth plastic inner surface and a fiber flocked outer surface.

15. A bed having an integral refuse disposal system comprising:

(a) a first mattress having a removable mattress insert therein, said insert having a top surface and a bottom surface and a first opening extending therethrough;

(b) a second mattress in contact with said first mattress and having a second opening extending therethrough and aligned with said first opening, the openings positioned to permit registration with a reclining patient;

(c) a seat member extending into said first opening and having a flange extending over and contacting the top surface of said removable mattress insert;

(d) an annular well formed in said mattress insert surrounding said opening; and (e) an annular cartridge of compressed disposable tubing positioned within said annular well and said disposable tubing extending upwardly from said cartridge over the flange of said seat member and downwardly through the first and second openings.

16. The bed of claim 15 wherein said well is formed by a capture ring having a cylindrical body mounted in said mattress insert and aligned with said opening adjacent the bottom surface of said mattress insert.

17. The bed of claim 15 wherein said disposable tubing has a smooth plastic inner surface and a soft moisture absorbent outer surface.

18. The bed of claim 15 wherein said disposable tubing has a smooth plastic inner surface and a fiber flocked outer surface.

* * * * *